US006381424B1

(12) United States Patent
Takahashi et al.

(10) Patent No.: US 6,381,424 B1
(45) Date of Patent: Apr. 30, 2002

(54) TONER CHARGE CONTROL FOR IMAGE DEFECT REDUCTION

(75) Inventors: Tetsu Takahashi; Atsushi Tano; Kunihiko Sato, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/667,755

(22) Filed: Sep. 21, 2000

(30) Foreign Application Priority Data

Oct. 28, 1999 (JP) ..... 11-307270

(51) Int. Cl.[7] ..... G03G 15/06; G03G 15/08
(52) U.S. Cl. ..... 399/55; 399/285
(58) Field of Search ..... 399/55, 284, 285

(56) References Cited

U.S. PATENT DOCUMENTS

| | | | | |
|---|---|---|---|---|
| 5,404,211 A | * | 4/1995 | Hashimoto et al. | 399/284 X |
| 5,689,784 A | * | 11/1997 | Shin et al. | 399/285 |
| 6,049,688 A | * | 4/2000 | Hayashi et al. | 399/284 |
| 6,055,402 A | * | 4/2000 | Angst et al. | 399/284 X |
| 6,229,979 B1 | * | 5/2001 | Ishii et al. | 399/284 X |

FOREIGN PATENT DOCUMENTS

| | | |
|---|---|---|
| JP | 58-70258 | 4/1983 |
| JP | 58-70259 | 4/1983 |
| JP | 03-71162 | 3/1991 |
| JP | 05-241437 | 9/1993 |
| JP | 05-346733 | 12/1993 |
| JP | 08-30093 | 2/1996 |

* cited by examiner

*Primary Examiner*—Fred L. Braun
(74) *Attorney, Agent, or Firm*—Armstrong, Westerman & Hattori, LLP

(57) ABSTRACT

A charge amount controlling roller serving as a charge amount controlling member is placed to face to a developing roller and is disposed on an upstream side, in a rotation direction of the developing roller, of a developing position at which a photosensitive drum and the developing roller face to each other. The charge amount controlling roller is biased with a voltage having the same polarity as that of non-latent-image portions on the photosensitive drum with respect to the developing roller, thereby reducing extraordinarily charged developing agents, or high charged, low charged, reverse charged toners otherwise causing image defects such as fogs.

10 Claims, 7 Drawing Sheets

TONER CHARGE CONTROL FOR IMAGE DEFECT REDUCTION

BACKGROUND OF THE INVENTION

1. Field of the Invention

This invention relates to a developing apparatus for developing latent images formed on a latent image carrier using electrostatic force by rendering toner particles cling as developing agents and to an image forming apparatus such as a printer or photocopier for forming images in use of this developing apparatus and, more particularly, to a developing apparatus and an image forming apparatus in which image defects such as fogs and the like are reduced.

2. Description of Related Art

With image forming apparatuses using electrophotographic technology such as photocopiers and printers, a non-magnetic single-component development process, so called, has been known in which non-magnetic materials make toner particles serving as developing agents and in which the apparatuses develop latent images formed on a latent image carrier such as a photosensitive drum. FIG. 11 shows an example of a conventional image forming apparatus using such a non-magnetic single-component development process. Around the photosensitive drum 81, provided are a charger 82 for charging the photosensitive drum 81, a light emitting device exposing section 83 for exposing the surface of the toners 87 onto the photosensitive drum 81, a transfer roller 86 for transferring the developed images on a sheet 90, and a cleaning blade 88 for removing toners remaining on the photosensitive drum.

The toners 87 are supplied onto the developing roller according to rotation of a reset roller from the cartridge. The developing roller 84 at that time is biased to a voltage of about −320 V, and latent image portions on the photosensitive drum 81 are set to about −100 V where non-latent-image portions are set to about −700 V. The toners conveyed by the developing roller 84 are those of charged non-magnetic toners and designed to have a prescribed negative voltage from frictions made by the reset roller 89. The toners 87 on the developing roller 84 are in contact with the blade to keep a prescribed thickness (e.g., 10 $\mu$m to 40 $\mu$m). The toners 87 are made to jump onto or come in contact with the latent image portions on the photosensitive drum 81 at a position where the developing drum 84 faces to the photosensitive drum, thereby developing electrostatic latent images.

The transfer roller 86 transfers the developed toners 87 on the latent image portions onto the sheet 90, and the toners are fixed subsequently to the sheet. The cleaning blade 88 scrapes the toners passing through the transfer roller 86 and remaining on the photosensitive drum. In a meantime, the reset roller 89 scrapes the toners remaining on the developing roller 84.

The printed images made by a printing system using such an electrophotographic process tend to be subject to image defects such as fogs and printing failures on fine lines. One of the reasons is that, because toners have distributed charge amounts, the toners having charges deviated from the center of the distribution do not properly contribute to image formation.

FIG. 12 is a diagram showing a charge amount distribution of the negatively charged non-magnetic single-component toners. These toners are to be used between the developing roller and the photosensitive drum, which are in the above voltage relationship; the toners are structured to be charged negatively; and the charge targeted amount Ct is a minus value. However, all the toners are not uniformly charged to have the targeted value Ct and form a Gaussian distribution as shown in FIG. 12 in respect to the charge amounts. In FIG. 12, according to the charge amount distribution of the toners, there are a distribution Fn1 located on a lower voltage side of a distribution Fp having the targeted charge amount Ct at the center of the distribution, and distributions Fn2, Fn3 on a higher voltage side of the distribution Fp. Those distributions Fn1 to Fn3 may bring image failures such as fogs from the following mechanism.

That is, force exerted to the toners on the developing roller and the photosensitive drum during development of the electrostatic latent images can be thought as a summation of, generally, electrostatic force, mirror image force, and other forces. The electrostatic force is proportioned to the charge amount of the toners; the mirror image force is a negative force (i.e., in a direction attracted from the developing roller and the photosensitive drum) proportioned to a square of the charge amount of the toners; other forces are forces such as liquid crosslinking force, van der Waals attraction, etc. which are not depending on the charge amount of the toners.

The toners contained in the distribution Fn1, or high charged toners, have the mirror image force and other forces significantly larger than the electrostatic force, and as a general rule, the toners become strongly clinging to the developing roller. With the so-called jumping development method in which toners jump, however, most of toners move back and forth between the developing roller and the photosensitive drum, and therefore, the high charged toners contained in the distribution Fn1 may jump to the side of the photosensitive drum from this influence. Because the toners thus jumping are easily made to cling to the photosensitive drum with strong mirror image force, the toners may cause image defects such as fogs. With the low charged toners contained in the distribution Fn2, the charge itself is so weak, and therefore, the electrostatic force is smaller than the summation of the mirror image force and other forces. Accordingly, such the low charged toners may cling to the non-latent-image portions on the photosensitive drum, thereby creating causes of fogs. The reverse charged toners contained in the distribution Fn3 are charged with the reverse polarity to the targeted charge amount Ct, and the reverse charged toners tend to make developments on the non-latent-image portions by the electrostatic force.

As an approach to remove the low charged toners, an art has been known in which a conductive roller biased with a direct current voltage having the reverse polarity to the toners is placed to a position facing the developing roller. Another known art has a structure that a conductive roller biased with a direct current voltage having the same polarity to the toners is placed to a position facing to the developing roller. However, those arts are no more than removing the prescribed charged toners and do not operate for removing all the charged toners: the high charged (Fn1), the low charged (Fn2), and the reverse charged (Fn3). Those arts do not regulate the voltages of the photosensitive drum, the developing roller, and the conductive roller, so that the toner removal effect may not be obtained according to the voltage relations among the drum and the rollers.

SUMMARY OF THE INVENTION

It is an object of the invention to provide a developing apparatus and an image forming apparatus for reducing at the same time high charged, low charged, and reverse charged developing agents, as described above, before the development at the latent image carrier.

In a developing apparatus as an embodiment of the invention, a developing apparatus for developing latent images includes a latent image carrier on which latent images are formed; a developing roller for developing latent images on the latent image carrier by forming a layer made of developing agents on the developing roller; and a charge amount controlling member to which a voltage having the same voltage polarity, with respect to the voltage of the developing roller, as the voltage polarity of non-latent-image portions on the latent image carrier is fed, the charge amount controlling member being disposed in facing to a surface of the developing roller on an upstream side, in a rotation direction of the developing roller, of a position at which the latent image carrier and the developing roller face to each other.

By disposing the charge amount controlling member on the upstream side, in the developing rotation direction, of the position at which the latent image carrier and the developing roller face to each other, developing agents otherwise causing fogs are captured by the charge amount controlling member before reaching the non-latent-image portions on the latent image carrier, and therefore, the apparatus can prevent image defects from occurring in advance.

With the developing apparatus according to the invention, the developing roller has a structure in non-contact with the latent image carrier or in contact with the latent image carrier. Where the developing roller is not in contact with the latent image carrier, the developing roller is biased with an alternative voltage to jump the developing agents and render the agents cling to the latent image carrier according to the alternative voltage. Before the developing agents jump to cling to the latent image carrier, the disposed charge amount controlling member removes unnecessary developing agents. Where the developing roller is in contact with the latent image carrier, the developing agents can be made to cling to the latent image carrier at a position at which the latent image carrier and the developing roller face to each other, so that the charge amount controlling member can remove unnecessary developing agents in substantially the same way.

According to an embodiment of the developing apparatus of the invention, a time average value of electric field intensity at a position that the distance between the charge amount controlling member and the developing roller becomes the shortest is no less than a time average value of electric field intensity between the developing roller and the non-latent-image portions on the latent image carrier.

By rendering the time average value of electric field intensity at the shortest distance position to the charge amount controlling member set no less than the time average value of electric field intensity to the non-latent-image portions on the latent image carrier, the developing agents can be attracted with good efficiency to the charge amount controlling member. Moreover, the voltage polarity of the charge amount controlling member with respect to the developing roller may be made to have the same polarity as that of charges given to the developing agents. The charge amount controlling member may be made of a roller member or a plate member.

In an embodiment of the developing apparatus of the invention, a developing agent collecting voltage for directing electrostatic force exerted to the developing agents clinging to the charge amount controlling member in a direction from the charge amount controlling member toward the developing roller is fed between the developing roller and the charge amount controlling member at a position that an image non-forming region forming no image exists on the latent image carrier. Therefore, before the developing agents are excessively made to cling to the charge amount controlling member, the developing agents can be effective collected from the charge amount controlling member, so that the developing agent clinging ability of the charge amount controlling member can be always maintained. The developing agent collecting voltage may be a voltage rendering the voltage polarity of the charge amount controlling member with respect to the developing roller the same polarity as the charges possessed by the developing agents clinging to the charge amount controlling member, and for example, the developing agent collecting voltage includes a direct current voltage component and an alternative current voltage component. Such selection of the polarity makes possible removals of the developing agents according to nature of the developing agents charged extraordinarily.

The image forming apparatus of the invention includes a latent image carrier on which latent images are formed; latent image forming means for forming the latent images on the latent image carrier; a developing apparatus for developing the latent images formed on the latent image carrier; and transferring means for transferring the developed images on the latent image carrier to a transfer material, wherein the developing apparatus includes a developing roller for conveying developing agents to the latent image carrier for development, and a charge amount controlling member to which a voltage having the same voltage polarity, with respect to the voltage of the developing roller, as the voltage polarity of non-latent-image portions on the latent image carrier is fed, the charge amount controlling member being disposed in facing to a surface of the developing roller on an upstream side, in a rotation direction of the developing roller, of a position where the latent image carrier and the developing roller face to each other.

The image forming apparatus of the invention has the structure that the latent images are formed on the latent image carrier and that after the latent images are developed the images on the latent image carrier are transferred to the transfer material, and by disposing the charge amount controlling member on the upstream side, in the rotation direction of the developing roller, of the position at which the latent image carrier and the developing roller face to each other, developing agents otherwise causing fogs are captured by the charge amount controlling member before reaching the non-latent-image portions on the latent image carrier. Therefore, the apparatus can prevent image defects from occurring in advance.

With such an image forming apparatus, a developing agent collecting voltage for directing electrostatic force exerted to the developing agents clinging to the charge amount controlling member in a direction from the charge amount controlling member toward the developing roller is fed between the developing roller and the charge amount controlling member where an image non-forming region that forms no image exists on the latent image carrier. Therefore, before the developing agents are excessively made to cling to the charge amount controlling member, the developing agents can be effective collected from the charge amount controlling member, so that the developing agent clinging ability of the charge amount controlling member can be always maintained.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF THE PREFERRED EMBODIMENTS

The first embodiment of the invention is an example of an image forming apparatus using a negative charged non-magnetic single-component jumping development method and a developing apparatus used in the image forming apparatus. The image forming apparatus has a structure of an image forming mechanism such as a photocopier, a facsimile machine, a printer, and the like of an electrophotographic method. In this specification, "image" means that including a variety of information such as letters, signs, and the like in addition to general drawings, photos, pictures, etc.

Figure 1:
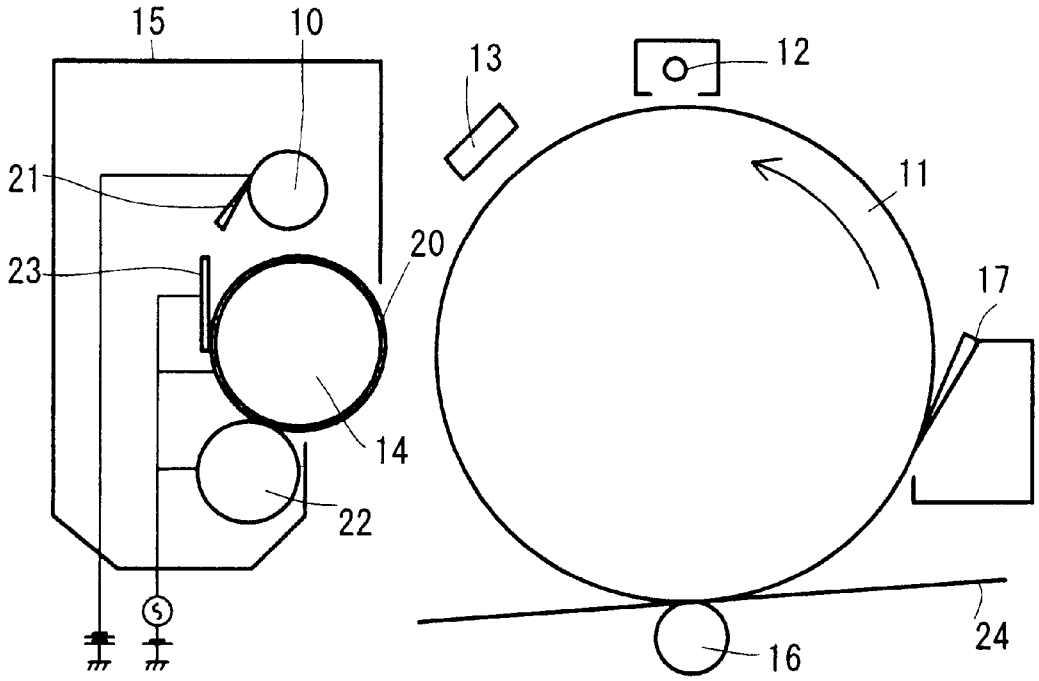
FIG. 1 is a cross-sectional illustration showing a developing apparatus and an image forming apparatus according to a first embodiment of the invention.

FIG. 1 shows an essential portion of the image forming apparatus of the embodiment. Around a photosensitive drum 11 as a cylindrical latent image carrier, provided are a charger 12 for uniformly charging a surface of the photosensitive drum 11 to a prescribed voltage, a light emitting device block 13 for forming, by radiating light on the photosensitive drum 11, latent images corresponding to images to be printed, a developing unit 15 in which a developing roller 14 is incorporated to supply toners serving as developing agents onto a peripheral surface of the photosensitive drum 11, a transfer roller 16 for transferring the images on the photosensitive drum 11 developed by toners to a transfer material such as a sheet, and a cleaning blade 17 for scraping toners remaining on the peripheral surface of the photosensitive drum.

The photosensitive drum 11 is a cylindrical latent image carrier made of an organic photoconductor, and the photosensitive drum 11 is mounted rotatively around a center shaft of the cylindrical shape by motor drive. Latent images are formed on a peripheral surface of the photosensitive drum 11, and images are developed thereat by toners. The charger 12 is an apparatus for charging uniformly the peripheral surface of the photosensitive drum 11 passing by a lower portion of the charger 12 prior to latent image formation. The charger 12 uniformly charges the peripheral surface of the photosensitive drum 11 at −700 V before light exposure in this embodiment.

The light emitting device block 13 has a light emitting device array or semiconductor lasers, as a light source, and is an apparatus for forming latent images by selectively exposing the peripheral surface of the photosensitive drum 11 to light. Signals to be fed to the light emitting device block 13 are signals based on image information read by, e.g., an internal scanner in the case of the photocopier or facsimile machine and signals fed from a computer, e.g., personal computer, or other electronic devices in the case of the printer. Light patterns irradiated from the light emitting device block 13 are corresponding to the images to be formed, and in this embodiment, light is not radiated to non-latent-image portions but is radiated to latent image portions. Accordingly, the peripheral surface of the photosensitive drum 11 passing by the light emitting device block 13 has the voltage of −100 V as a result of light radiation to the latent image portions, whereas the non-latent-image portions keep the voltage of −700 V It is to be noted that in this specification the non-latent-image portion means a region at which the toner should not exist finally and that the latent image portion means a region at which the toner should exist finally.

The transfer roller 16 is a member for transferring the images on the photosensitive drum 11 developed by the toners to a sheet such as plain paper or the like. Toners are transferred onto a sheet material upon passage of the sheet material between the transfer roller 16 and the photosensitive drum 11. The toners remaining on the photosensitive drum 11 even after passing by the transfer roller 16 are scraped by the cleaning blade 17, and the peripheral surface of the photosensitive drum 11 reaches the charger 12 in a state that no toner remains.

The developing unit 15 is an apparatus constituting the essential portions of this embodiment. The developing unit 15 includes, in addition to the developing roller 14, a reset roller 22 for supplying toners 20 of non-magnetic single-component serving as developing agents to the developing roller 14, a charge amount controlling roller 10 as a charge amount controlling member attached for the purpose of preventing image defects such as fogs, a cleaning blade 21 for scraping the toners 20 clinging to the charge amount controlling roller 10, and a blade 23 for controlling the toners 20 fed on the developing roller 14 to have a constant thickness.

The developing roller 14 is a cylindrical member made of, e.g., aluminum. A rotary shaft of the developing roller 14 is placed as extending in parallel to the rotary shaft of the photosensitive drum 11, and the developing roller 14 is placed so that the peripheral surface of the developing roller 14 is located at a position 300 micron away from the surface of the photosensitive drum 11. Therefore, the developing roller 14 is in non-contact with the photosensitive drum 11. During a printing phase that the image forming region on the photosensitive drum 11 faces to the developing roller 14, the developing roller 14 is biased with a direct current voltage of −400 V and also biased with an alternative current voltage having a peak to peak voltage Vpp around 1 to 4 kV with 2 k to 8 k Hz frequency. As toners 20 come closer to the photosensitive drum 11, the negatively charged non-magnetic single-component phenomenon in which the toners 20 jump occurs between the developing roller 14 and the photosensitive drum 11.

The reset roller 22 is an apparatus to triboelectrically charge the toners 20 filled in the developing unit 20 and to supply the toners 20 to the developing roller 14. The rotary shaft of the reset roller 22 is placed as extending in parallel to the rotary shaft of the developing roller 14. The reset roller 22 has a structure with a urethane based resin on the peripheral surface. During a period of the printing phase, the reset roller 22 is biased in the same way as the developing roller at a direct current voltage of −400 V and also biased with an alternative current voltage having a peak to peak voltage Vpp around 1 to 4 kV with 2 k to 8 k Hz frequency.

The blade 23 to which the same voltage fed to this reset roller 22 is fed is a member to regulate the toners supplied onto the developing roller 14 to have a constant thickness. The blade 23 is structured of, e.g., stainless steel (SUS). The blade 23 is made in contact with the developing roller 14 in the counter direction to the rotary direction of the developing roller 14, and as a result, the thickness of the toners on the developing roller 14 is formed to have a uniform thickness of 10 $\mu$m to 40 $\mu$m.

The charge amount controlling roller 10 is a member attached within the developing unit 15 for the purpose of preventing image defects such as fogs or the like. In this embodiment, the roller 10 is a cylindrical member made of aluminum. The rotary shaft of the charge amount controlling roller 10 is also placed as extending in parallel to the rotary shafts of the developing roller 14 and the photosensitive drum 11. The charge amount controlling roller 10 is disposed in facing to a surface of the developing roller 14 on an upstream side, in a rotation direction of the developing roller, of a position at which the photosensitive drum 11 and the developing roller 14 face to each other. The position at which the photosensitive drum 11 and the developing roller 14 face to each other means a position for development at which the photosensitive drum 11 is located closest to the developing roller 14. At that position, the developing roller 14 is not in contact with the photosensitive drum 11 in this embodiment. In FIG. 1, the upstream side in the rotation direction of the developing roller is a direction proceeding reverse to the arrow direction on the developing roller from the position at which the photosensitive drum 11 and the developing roller 14 face to each other. The charge amount controlling roller 10 is located above the position of the developing roller 14 inside the developing unit 15.

The charge amount controlling roller 10 is also not in contact with the developing roller 14. The peripheral surface of the developing roller 14 is placed at a position 300 micron away from the peripheral surface of the charge amount controlling roller 10. A voltage of about −700 V is biased to the charge amount controlling roller 10. The voltage of about −700 V is the same as the potential of the non-latent-image portions on the photosensitive drum 11. The charge amount controlling roller 10 rotates in the counterclockwise direction in FIG. 2, the circumferential rate of the roller 10 is set equally to that of the developing roller 14. The relation of the distance and voltage between the charge amount controlling roller 10 and the developing roller 14 is the same as the relation of the distance and voltage between the photosensitive drum 11 and the developing roller 14, and the distance is for isolation not causing any aerial discharge. If discharge occurs, it is difficult to provide uniform electric field to the toners on the developing roller, thereby making difficult to form good images. Therefore, the distance between the charge amount controlling roller 10 and the developing roller 14 is set to create the isolation not causing any aerial discharge, so that unnecessary image defects can be avoided.

The cleaning blade 21 for removing the toners adhering to the periphery of the charge amount controlling roller 10 is made in contact with the charge amount controlling roller 10 in a counter direction to the rotary direction of the charge amount controlling roller 10, and as a result, the peripheral surface of the charge amount controlling roller 10 right before facing to the developing roller 14 becomes in a state that all the toners are scraped. The toners scraped from the charge amount controlling roller 10 are mixed with toners within the developing unit 15.

Figure 2:
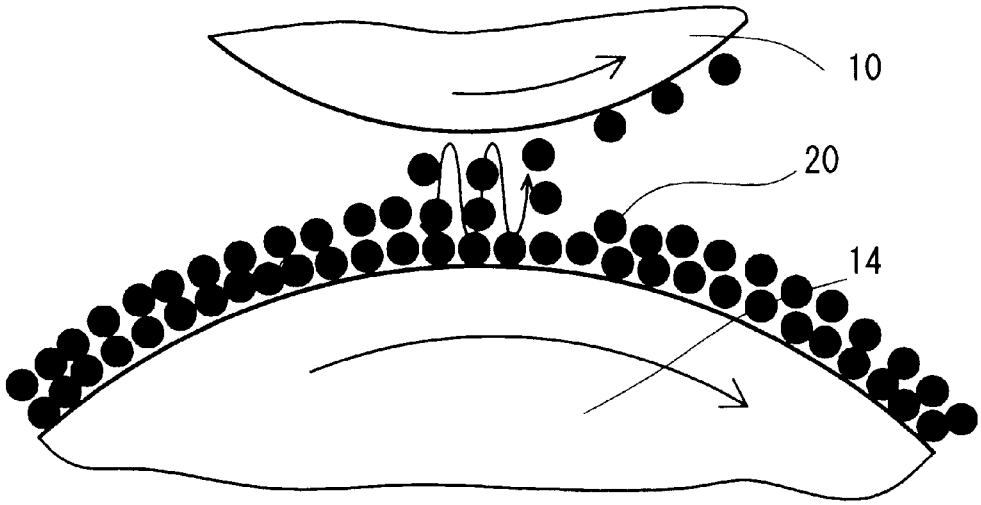
FIG. 2 is an enlarged cross-sectional illustration showing a charge amount controlling roller and a developing roller in the developing apparatus shown in FIG. 1.
Figure 3:
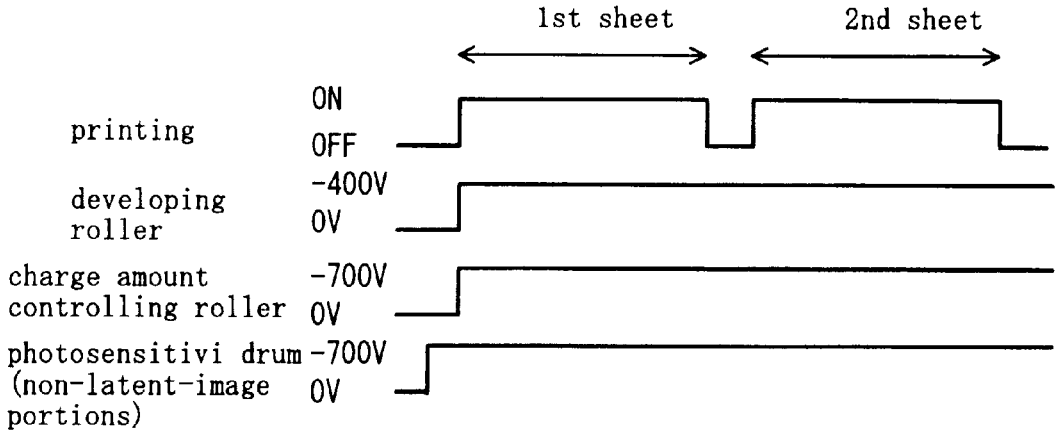
FIG. 3 is a timing chart showing voltages fed to respective members of the developing apparatus shown in FIG. 1.

In the image forming apparatus of this embodiment, as shown in FIG. 2, toners jump from the peripheral surface of the developing roller 14 that comes closer to the charge amount controlling roller 10 according to the alternative current voltage fed to the developing roller 14, and each of high charged toners, low charged toners, and reverse charged toners is captured by the charge amount controlling roller 10, which is not in contact with the developing roller 14. FIG. 3 is a timing chart showing control voltage for capturing those unnecessary toners at the peripheral surface of the charge amount controlling roller 10. In FIG. 3, the portion that printing is in an ON state means a printing phase, which corresponds to an image forming region on the photosensitive drum 11. The period between two printing phases corresponds to an image non-forming region between the image forming regions on the photosensitive drum 11. It is to be noted that during the printing phase, the non-latent-image portions at which no printing is made may exist, and those portions are categorized as non-latent-image portions on the photosensitive drum (or regions where no light exposure is made) in this embodiment. In this embodiment, after start of the printing phase, the developing roller is kept at −400 V (showing only the direct current component for the sake of simplicity), where the charge amount controlling roller and the photosensitive drum 11 are kept at −700 V.

Figure 12:
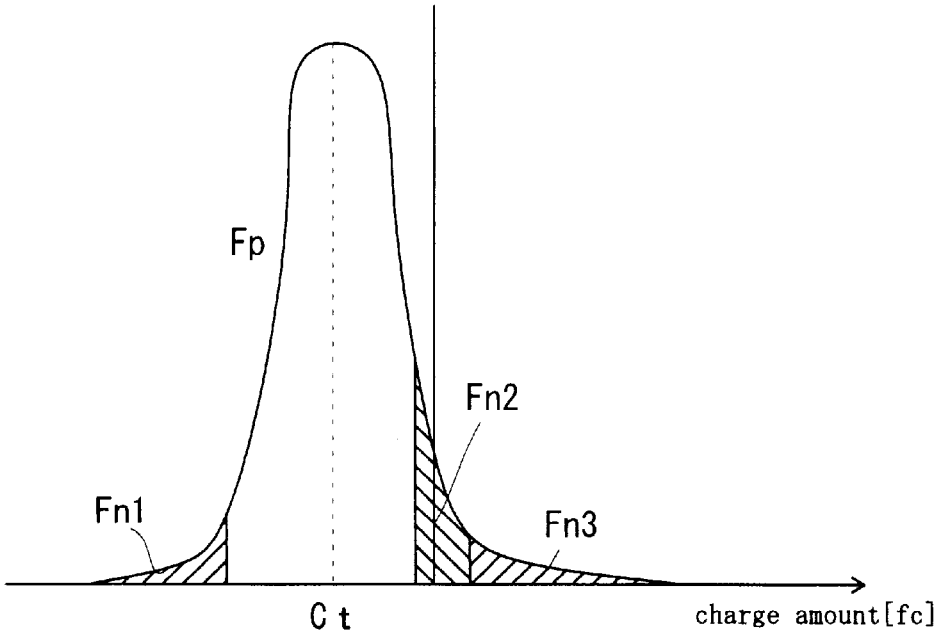
FIG. 12 is a diagram showing a charge amount distribution of non-magnetic single-component toners.

The charge amount controlling roller 10 thus structured removes unnecessary toners by the following operation and prevents image defects from occurring beforehand. That is, in this embodiment, since negatively charged nonmagnetic single-component toners are used as the developing agents, the targeted charge amount Ct is a negative voltage as shown in FIG. 12. With the distributions Fn1, Fn2, Fn3 of the respective toners, which may otherwise cause image defects, as the high charged toners (i.e., toners contained in the distribution Fn1) basically remain attached to the developing roller 14, the toners of an ordinary charge amount move back and forth between the developing roller 14 and the charge amount controlling roller 10 according to the applied alternative current voltage, thereby rendering a part of the high charged toners clinging to the charge amount controlling roller 10. Accordingly, the attaching amount of the high charged toners to the photosensitive drum 11 having the same voltage relation as the charge amount controlling roller 10 is surely reduced, so that the image defects such as fogs are reduced.

The low charged toners (i.e., toners contained in the distribution Fn2) jump in the same way from the influences of toners back and forth moving by electrostatic force and cling to the peripheral surface of the charge amount controlling roller 10 by mirror image force and other forces when contacting to the charge amount controlling roller 10. The clinging amount of the low charged toners to the photosensitive drum 11 is therefore surely reduced, so that the image defects such as fogs are reduced. The reverse charged toners (i.e., toners contained in the distribution Fn3) receive force directing the toners toward the charge amount controlling roller 10 by the direct current component fed to the developing roller 14, and as a result, the toners are attached to the charge amount controlling roller 10.

Thus, with the image forming apparatus of this embodiment, all of the high charged toners, the low charged toners, and the reverse charged toners, which otherwise cause image defects are made to cling to the charge amount controlling roller 10 before clinging to the photosensitive drum 11, so that clinging to the photosensitive drum 11 is surely reduced by that portion, so that image defects formed by the electrophotographic method can be reduced.

With the image forming apparatus according to this embodiment, the voltage relation and distance between the charge amount controlling roller 10 and the developing roller 14 are the same as the voltage relation and the distance between the photosensitive drum 10 and the developing roller 14, and more specifically, each distance is 300 $\mu$m, and the non-latent-image portions of the charge amount controlling roller 10 and the photosensitive drum 11 are biased with −700 V. However, the voltage relation and distance between the charge amount controlling roller 10 and the developing roller 14 may be set, as far as no aerial discharge occurs, that a time average value of electric field intensity at a position that the distance between the charge amount controlling roller 10 and the developing roller 14 becomes the shortest is no less than a time average value of electric field intensity between the developing roller 14 and the non-latent-image portions on the photosensitive drum 11. By thus designing the time average value on the side of the charge amount controlling roller 10 to be the same or stronger, the toners jumping from the developing roller 14 can be attracted with good efficiency toward the charge amount controlling roller 10, so that clinging onto the non-latent-image portions of the photosensitive drum 11 can be further reduced.

Figure 4:
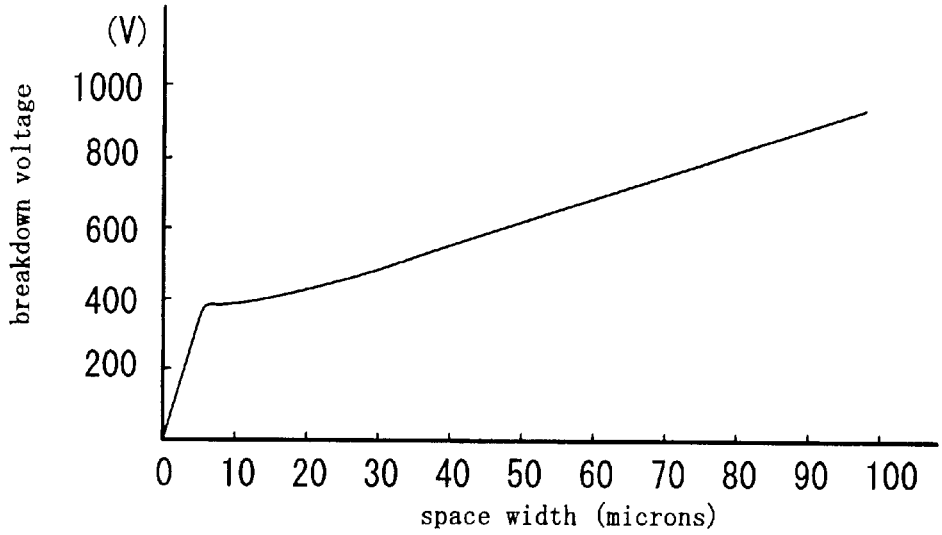
FIG. 4 is a diagram showing a relation between discharge voltage and space width, particularly for space width less than 100 microns.
Figure 5:
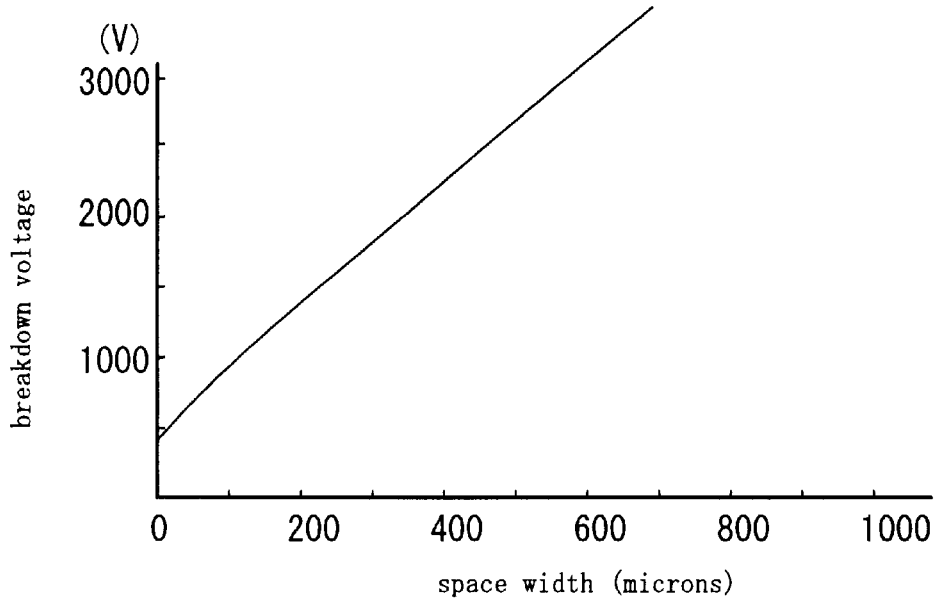
FIG. 5 is a diagram showing a relation between discharge voltage and space width, particularly for space width not less than 100 microns.

A range that no aerial discharge occurs is described in detail below. There is a relation shown in FIG. 4 and FIG. 5 in regard with the breakdown voltage at which discharge occurs and space, and the distance between the charge amount controlling roller 10 and the developing roller 14 can be set in consideration with this relation. The ordinates of FIG. 4, FIG. 5 indicate breakdown voltage at which aerial discharge occurs when reaching to that voltage, and the abscissas indicate space width. FIG. 4 indicates characteristics relating to space less than 100 microns; and FIG. 5 indicates characteristics relating to space equal to or more than 100 microns. Both diagrams approximately show curves becoming high as going right, and as space becomes larger, breakdown voltage becomes higher, and therefore, there is a tendency that discharge may not occur even where the voltage difference becomes larger. For example, if the distance of the charge amount controlling roller to the developing roller 14 is reduced to 250 microns from 300 microns, the breakdown voltage is about 1500 V with the space of 250 microns, and therefore, any discharge may not occur yet even where the same voltage is fed as it is. Accordingly, the ability of capturing the toners on the charge amount controlling roller 10 can be made higher as the distance is made shorter, so that unnecessary toners may be removed with good efficiency.

In the above embodiment, exemplified is a system that the toners as the developing agents have a negatively charged distribution center and that the negative voltage is fed to the photosensitive drum. The apparatus may have toners charged negatively, and the voltage of the developing roller can be set to a positive voltage (e.g., +400 V) whereas the photosensitive drum can be fed with positive voltages (e.g., the non-latent-image portion is at +700 V, and the latent image portion is at +100 V). In this situation, the toners are made to cling to the non-latent-image portions (regions not exposed to light) of the photosensitive drum to develop images. The charge of the toners can be positive, and the voltage of the developing roller can be set to a positive voltage (e.g., +400 V) whereas the photosensitive drum can be fed with positive voltages (e.g., the non-latent-image portion is at +700 V, and the latent image portion is at +100 V). In this situation, the toners are made to cling to the latent image portions (regions exposed to light) of the photosensitive drum to develop images. The charge of the toners can be positive, and the voltage of the developing roller can be set to a negative voltage (e.g., −400 V) in the same way as the above embodiment, whereas the photosensitive drum can be fed with negative voltages (e.g., the non-latent-image portion is at −700 V, and the latent image portion is at −100 V). In this situation, the toners are made to cling to the non-latent-image portions (regions not exposed to light) of the photosensitive drum to develop images. In other words, removals of extraordinarily charged toners of the high charged, the low charged, and the reverse charged toners in use of the charge amount controlling roller as a charge amount controlling member can be done with the reverse polarity in the charged polarity of the toners, and such a removal can be done even where the polarity of the voltages of the developing roller and the latent image carrier such as the photosensitive drum is the opposite.

Figure 6:
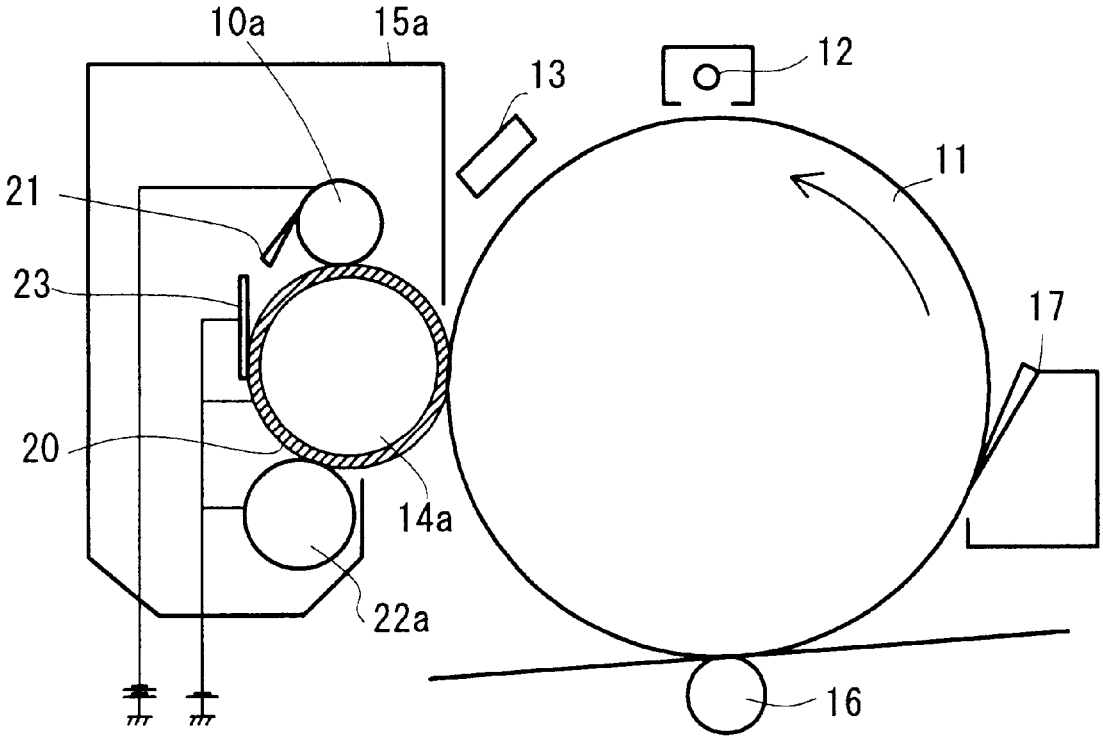
FIG. 6 is a cross-sectional illustration showing a developing apparatus and an image forming apparatus according to a second embodiment of the invention.

Next, referring to FIG. 6, an image forming apparatus and a developing apparatus used in this image forming apparatus according to the second embodiment are described. This embodiment is an example using a contact development method. The image forming apparatus of this embodiment has a photosensitive drum 11 having the same structure as that of the first embodiment. Around the photosensitive drum 11, provided are a charger 12 for charging a photosensitive drum surface to a prescribed voltage, a light emitting device block 13 for forming, by radiating light, latent images corresponding to images to be formed on the peripheral surface of the photosensitive drum 11, a developing unit 15*a* in which a developing roller 14 is incorporated to supply toners serving as developing agents onto the peripheral surface of the photosensitive drum 11, a transfer roller 16 for transferring the images on the photosensitive drum 11 developed by toners to a sheet such as a plain paper, and a cleaning blade 17 for scraping toners remaining on the peripheral surface of the photosensitive drum 11. The photosensitive drum 11, the charger 12, the light emitting device block 13, and the transfer roller 16, the cleaning blade 17 have the same structure as those in the first embodiment, so that a duplicated description is omitted.

The developing unit 15*a* of the developing apparatus of the second embodiment includes a charge amount controlling roller 10*a* for removing unnecessary toners, a developing roller 14*a* for making a contact development, a reset roller 22*a* for supplying the toners to the developing roller 14*a*, a blade 23 for regulating the toners supplied on the developing roller 14*a* to have a constant thickness, and a cleaning blade 21 for removing the toners clinging to the periphery of the charge amount controlling roller 10*a*.

The developing roller 14*a* is a cylindrical member having a structure formed with a urethane rubber layer on an outer peripheral surface of the core metal of the stainless steel (SUS). The rotary shaft of the photosensitive drum 11 and the rotary shaft of the developing roller 14*a* are disposed in parallel to each other, and the peripheral surface of the photosensitive drum 11 is made linearly in contact with the peripheral surface of the developing roller 14*a*. Therefore, the developing roller 14*a* makes contact development in which latent images are developed in supplying toners on the photosensitive drum 11 by contacting to the drum. A direct current voltage of −420 V is fed to the developing roller.

The reset roller 22*a* is disposed so that the rotary shaft of the roller 22*a* is placed in parallel to the rotary shaft of the developing roller 14*a*. The reset roller 22 has a cylindrical structure in which a foamed urethane rubber layer is formed on a peripheral surface of a core metal of the stainless steel (SUS) and is fed at −420 V of a direct current voltage, which is the same as the voltage fed to the developing roller. The blade 23 structured of, e.g., stainless steel (SUS) is also biased to −420 V of a direct current voltage, which is the same as the voltage fed to the developing roller. The thickness of the toner layer on the developing roller 14*a* is formed to have a uniform thickness of 10 μm to 40 μm.

The charge amount controlling roller 10*a* is a member mounted within the developing unit 15*a* for the purpose of preventing image defects such as fogs from occurring and is a cylindrical member made of aluminum. The rotary shaft of the charge amount controlling roller 10*a* is also placed extending in parallel to the rotary shafts of the developing roller 14*a* and the photosensitive drum 11. The charge amount controlling roller 10*s* is disposed in facing to a surface of the developing roller on an upstream side, in a rotation direction of the developing roller, of a position on the developing roller 14*a* at which the photosensitive drum 11 and the developing roller 14*a* face to each other, and the charge amount controlling roller 10*a* is disposed as in contact with the developing roller 14*a*. A voltage of about −700 V, which is the same as the voltage of the non-latent-image portions on the photosensitive drum 11, is given to the charge amount controlling roller 10*a*. The charge amount controlling roller 10*a* rotates in the counterclockwise direction in FIG. 6, and the circumferential rate is the same circumferential rate of the developing roller 14*a*.

With the image forming apparatus using such a contact development method, where the charge amount controlling roller 10*a* is used, all the toners of the high charged, the low charged, and the reverse charged toners otherwise causing image defects are made to cling to the charge amount controlling roller 10*a* before clinging to the photosensitive drum 11, so that clinging to the photosensitive drum 11 is surely reduced by that portion, and so that image defects formed by such an electrophotographic method can be reduced.

Figure 7:
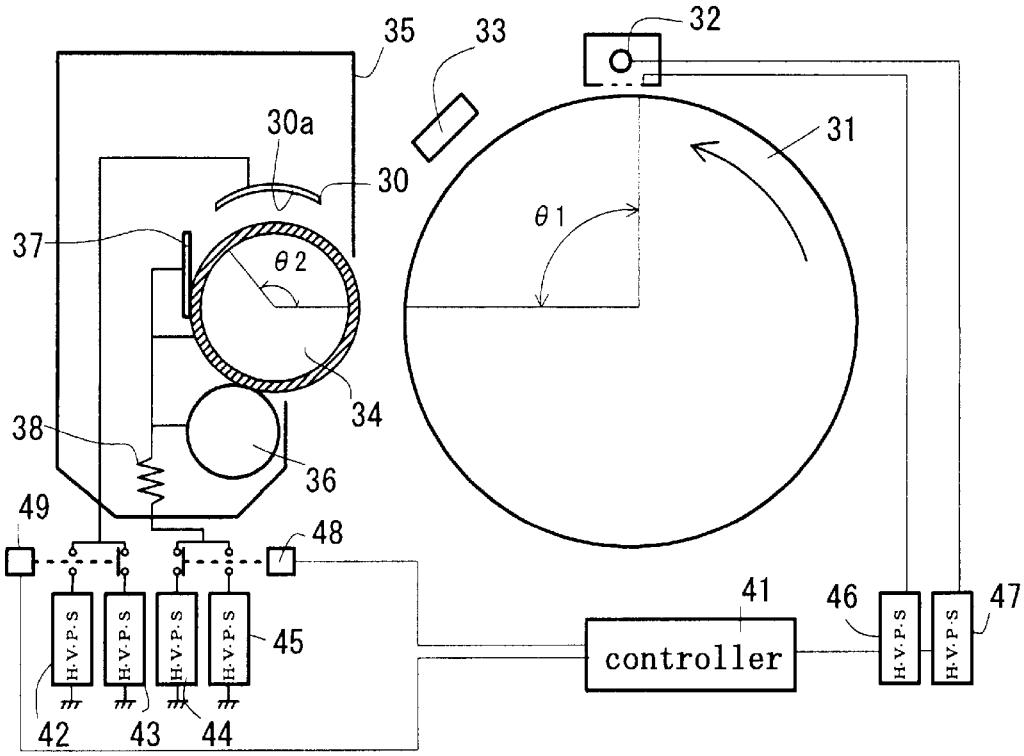
FIG. 7 is cross-sectional illustration showing a developing apparatus and an image forming apparatus according to a third embodiment of the invention.

Referring to FIG. 7 to FIG. 10, an image forming apparatus according to the third embodiment of the invention is described. This embodiment is an example having a charge amount controlling plate 30 as a charge amount controlling member. As shown in FIG. 7, the image forming apparatus of the third embodiment has a cylindrical photosensitive drum 31, and around the drum, has a charger 32 for charging the photosensitive drum 31, a light emitting device block 33 for forming electrostatic latent images on the peripheral surface of the photosensitive drum 31 by selective light radiation, and a developing unit 35 incorporating a developing roller 34 and a charge amount controlling plate 30. The toners used in this image forming apparatus are toners of negatively charged non-magnetic single-component. High voltage power sources 42 to 47 are connected to predetermined portions of the image forming apparatus, and connection and disconnection is controlled by a controller 41. It is to be noted that various apparatuses such as a transfer roller, and a cleaning blade are attached around the photosensitive drum 31, but in the drawing, those are omitted for the sake of simplicity.

The photosensitive drum 31 is a cylindrical latent image carrier made of an organic photoconductor. The photosensitive drum 31 is mounted rotatively around a center shaft of the cylindrical shape by motor drive. Latent images are formed on a peripheral surface of the photosensitive drum 31, and images are developed at the surface with toners serving as developing agents. The charger 32 is an apparatus for uniformly charging the peripheral surface of the photosensitive drum 31 passing by a lower portion of the charger 32 before latent image formation, and this charger 32 charges uniformly the peripheral surface of the photosensitive drum 31 at −700 V before light exposure in this embodiment. The charger 32 is a scorotron type charger, and a high voltage power source 47 supplies corona voltage for discharge while a high voltage power source 46 supplies a grid voltage to a grid. Those high voltage power sources 46, 47 are controlled to turn on and off by the controller 41. The light emitting device block 33 has an array made of light emitting devices or semiconductor lasers and forms latent images by selectively exposing with light the peripheral surface of the photosensitive drum 31.

The developing unit 35 includes a reset roller 36 for supplying non-magnetic single-component toners as developing agents to the developing roller 34, a charge amount controlling plate 30 attached for the purpose of preventing image defects such as fogs or the like, and a blade 37 for controlling the toners supplied onto the developing roller 34 to have a constant thickness. The developing roller 34 is a cylindrical member made of aluminum and provided in parallel to the shaft of the photosensitive drum 31. The developing roller 34 makes non-contact developments by placing the peripheral surface of the developing roller 34 at a position 300 micron away from the peripheral surface of the photosensitive drum 31. During a printing phase, the developing roller 34 is biased with a direct current voltage of −400 V and also biased with an alternative current voltage having a peak to peak voltage Vpp around 1 k to 4 kV with 2 k to 8 k Hz frequency. As toners come closer to the photosensitive drum 31, the negatively charged non-magnetic single-component phenomenon in which the toners jump occurs between the developing roller 34 and the photosensitive drum 31.

The reset roller 36 is a roller to triboelectrically charge the toners filled in the developing unit 35 and to supply the toners to the developing roller 34. The reset roller 36 has a structure with a urethane based resin on the peripheral surface. The blade 37 is a member structured of, e.g., stainless steel (SUS) to regulate the toners supplied onto the developing roller 34 to have a constant thickness of 10 μm to 40 μm. During a period of the printing phase, the reset roller 36 and the blade 37 are biased commonly as the developing roller at a direct current voltage of −400 V and also biased with an alternative current voltage having a peak to peak voltage Vpp around 1 to 4 kV with 2 k to 8 k Hz frequency. The power source is supplied via a compensation resistance 38 of 300 kΩ, and is supplied from a high voltage power source 44 or a high voltage power source 45 by switching a relay 48 with control from the controller 41.

Figure 8:
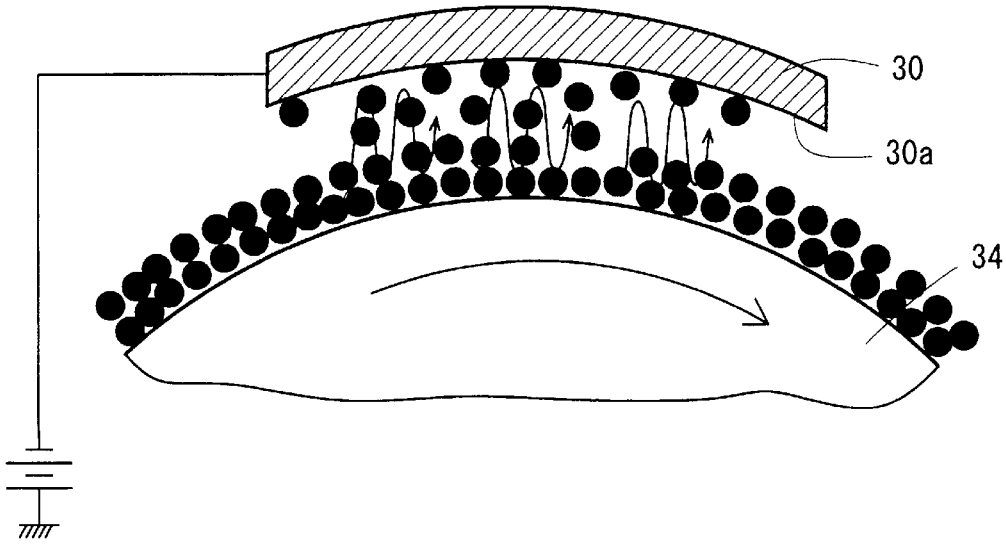
FIG. 8 is an enlarged cross-sectional illustration showing a charge amount controlling roller and a developing roller in the developing apparatus shown in FIG. 7.

The charge amount controlling plate 30 is a member attached within the developing unit 35 for the purpose of preventing image defects from occurring and, in this embodiment, is made of aluminum. The charge amount controlling plate 30 is disposed in facing to a surface of the developing roller 34 on an upstream side, in a rotation direction of the developing roller, of a position at which the photosensitive drum 31 and the developing roller 34 face to each other. The charge amount controlling plate 30 is a rectangular plate extending in an axial direction of the developing roller 34 and is formed with a surface curving along the peripheral surface of the developing roller 34. That is, the charge amount controlling plate 30 has a shape that any portion within an opposing surface 30*a* of the charge amount controlling plate 30 to the developing roller 34 on the side of the developing roller 34 takes a constant distance from the peripheral surface of the developing roller 34, and therefore, the electric field formed by the charge amount controlling plate 30 becomes uniform on the opposing surface 30*a*. As shown in FIG. 8, the charge amount controlling plate 30 is located on an upper side of the developing roller 34 in substantially the same way as in the first embodiment, and the toners otherwise causing fogs are attracted upward during passage below the charge amount controlling plate 30 and captured by the opposing surface 30*a* of the charge amount controlling plate 30.

The power source supplies a predetermined voltage to such a charge amount controlling plate 30. The voltage fed to the charge amount controlling plate 30 is set to switch the route between a high voltage power source 42 and a high voltage power source 43 by a relay 49. These switching operations arc done based on switching signals from the controller 41 as described below. During the printing phase, a voltage of −700 V is supplied to the charge amount controlling plate 30, and the toners otherwise causing fogs, or all the toners possibly causing image defects such as the high charged toners, the low charged toners, the reverse charged toners are made to cling to the charge amount controlling plate 30 prior to clinging to the photosensitive drum 31, so that clinging to the photosensitive drum 31 is surely reduced by that portion, and so that image defects formed by the electrophotographic method can be reduced.

Figure 9:
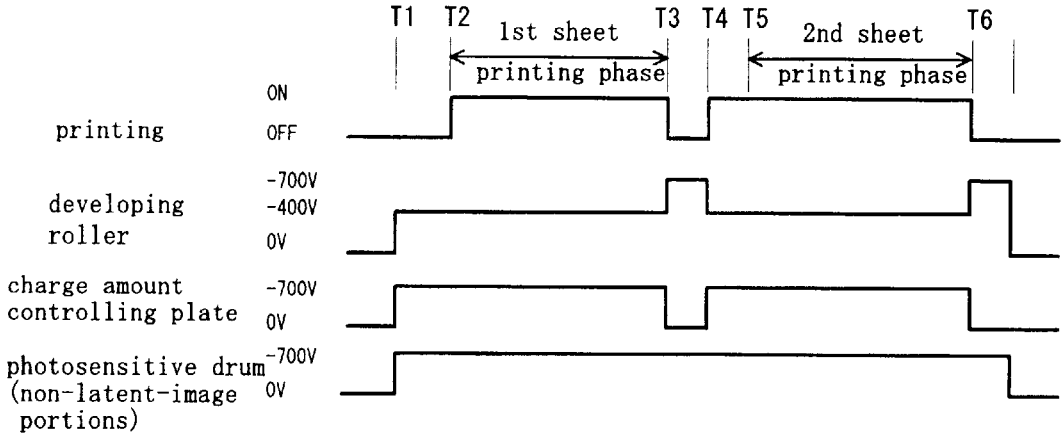
FIG. 9 is a timing chart showing an example of voltages fed to respective members of the developing apparatus shown in FIG. 7.
Figure 10:
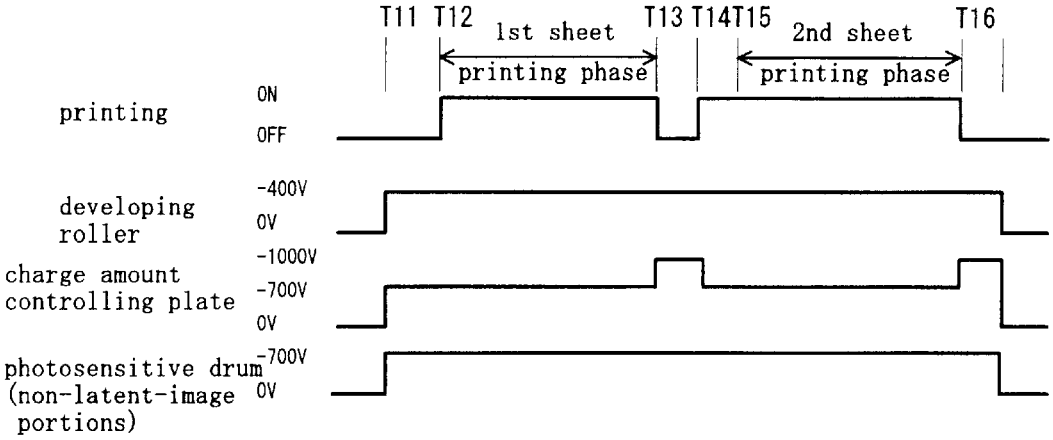
FIG. 10 is a timing chart showing another example of voltages fed to respective members of the developing apparatus shown in FIG. 7.
Figure 11:
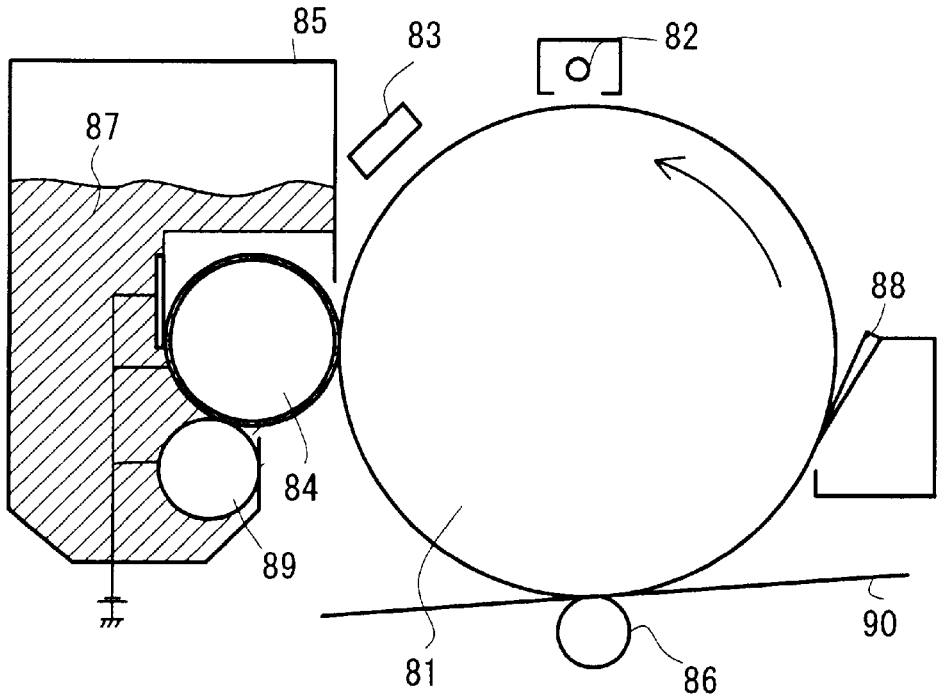
Fig.11 PRIOR ART
FIG. 11 is a cross-sectional illustration showing an image forming apparatus as a prior art.

In the third embodiment, the shape of the charge amount controlling plate is in a plate and not suitable for providing a blade. The embodiment is therefore required to remove the clinging toners from the charge amount controlling plate 30 while collecting the toners otherwise causing image defects. With this embodiment, while an image non-forming region between image forming regions on the photosensitive drum 31 is located at a position at which the photosensitive drum 31 and the developing roller 34 face to each other, a toner collecting voltage in which electrostatic force exerted to the toners clinging to the charge amount controlling plate 30 directs from the charge amount controlling plate 30 to the developing roller 34 is fed to the developing roller 34 and the charge amount controlling plate 30. Now referring to FIG. 9 and FIG. 10, operation in accompanying with toner collection from the charge amount controlling plate 30 is described. FIG. 9 is an example of toner collecting voltage effective in the case where the reverse charged toners are causing fogs, and FIG. 10 is an example of toner collecting voltage effective in the case where the high charged toners are causing fogs. In FIG. 9 and FIG. 10, only direction current portions of the voltages are indicated, and the alternative current portions are omitted from the drawings.

In the timing chart of FIG. 9, the voltages of the charge amount controlling plate 30 and the photosensitive drum 34 are shifted from 0 V to −700 V at timing T1, and the voltage of the developing roller 34 is shifted from 0 V to −400 V to enter the apparatus into a using status. Those voltage supplies are made, from the control signals from the controller 41, by rendering the respective power sources 46, 47 to supply power to the charger 32, connecting the high voltage power source 42 to the charge amount controlling plate 30, and feeding a voltage from the high voltage power source 45 via the compensation resistance 38 to the developing roller 34, the reset roller 36, and the blade 37. Those voltage relations began clinging to the charge amount controlling plate 30 the toners otherwise causing fogs on the developing roller 34.

The apparatus enters in a printing phase of the first sheet at timing T2. Timing T2 corresponds to a time that the toner layer facing to the upstream side end of the charge amount controlling plate 30 reaches the developing position between the developing roller 34 and the photosensitive drum 31, and in FIG. 7, timing T2 corresponds to time that the developing roller 34 rotates by an angle θ2. After this timing T2 is passed, the toner layer arriving at the developing position is in a state that the toners otherwise causing fogs are adequately reduced by electric field produced by the charge amount controlling plate 30, and therefore, the toners clinging to the non-latent-image portions of the photosensitive drum 31 are reduced.

Between timing T2 and timing T3 is a period of printing phase. The region on the photosensitive drum 31 passing at the developing position during this printing phase period is the image forming region. During this period, developments are made at the developing position with toners according to the electrostatic latent images formed by the light emitting device block 33, and unnecessary toners are already removed, so that image defects such as fogs are reduced.

Subsequently, passing of the image forming region over the developing position ends at timing T3, and when the image non-forming region reaches the developing position, the voltages fed to the charge amount controlling plate 30 and the developing roller 34 and the like are switched to ones from the high voltage power source 43, 44 according to the control signal of the controller 41. The voltage of the charge amount controlling plate 30 is shifted from −700 V to 0 V (i.e., ground level), and the voltage of the developing roller 34 and the like is shifted from −400 V to −700 V. Consequently, the electric field between the charge amount controlling plate 30 and the developing roller 34 has a direction that the electrostatic force exerted to the reverse charged (positively charged) toners clinging to the charge amount controlling plate 30 directs from the charge amount controlling plate 30 toward the developing roller 34 with respect to the reverse charged toners which are positively charged. Application of such a developing agent collecting voltage removes the reverse charged toners clinging to the charge amount controlling plate 30, so that the charge amount controlling plate 30 continuously removes the toners otherwise causing fogs.

Such a developing agent collecting voltage is applied until timing T4. Now, time (T3 to T4) is described in detail. For example, it is presumed that the peripheral speed of the photosensitive drum 31 is 100 mm/sec, that the size of the image non-forming region between the image forming regions is 50 mm, that the peripheral speed of the developing roller 34 is equal to the peripheral speed of the photosensitive drum 31, that the diameter of the developing roller 34 is 18 mm, that the diameter of the photosensitive drum 31 is 30 mm, that the angle θ2 is 120 degrees. First, because the size of the image non-forming region is 50 mm and because the peripheral speed is 100 mm/sec, the time that the image non-forming region passes over the developing position is 0.5 sec. This time of 0.5 second is for period for passage of the image non-forming region (T3 to T5). Since the angle θ2 is 120 degrees, the developing roller 34 takes about 0.19 second for rotation of angle θ2 from a calculation, 0.18π× 120/360. Therefore, time about 0.19 second is required as timing T4 to start early from timing T5 beforehand, and the remaining time (T3–T4) of 0.31 second can be used for application of the developing agent collecting voltage. This period that the developing agent collecting voltage applies is adequate to remove the toner other causing fogs from the charge amount controlling plate 30. The timing to feed the prescribed voltage for image formation to the charger 32 is about 0.23 or more second earlier than timing T1 from a calculation, 0.30π×90/360.

After the developing agent collecting voltage is applied to the charge amount controlling plate 30 and the developing roller 34 until timing T4, between timing T4 and the timing T5, the voltage of the charge amount controlling plate 30 is again shifted from 0 V to −700 V, and the voltage of the developing roller 34 and the like is also shifted from −700 V to −400 V, thereby entering the use status. The apparatus enters at timing T5 into the printing phase of the second sheet, and prescribed images are formed. At timing T6, the developing agent collecting voltage is again supplied to the charge amount controlling plate 30 and the developing roller 34. Subsequently, this operation is repeated as increase of the sheet number to be printed.

By such application of the developing agent collecting voltage as shown in FIG. 9 while the image non-forming region is arriving at the developing position, in the image forming apparatus of this embodiment, the reverse charged toners are effectively removed from the charge amount controlling plate 30, and therefore, the apparatus can make electrophotographic images in preventing fogs from occurring.

FIG. 9 indicates an example that the clinging toners removed from the charge amount controlling plate 30 by the developing agent collecting voltage are reverse charged toners, but FIG. 10 indicates an example that the clinging toners removed from the charge amount controlling plate 30 are the same negative, high charged toners.

At timing T11, the voltages of the charge amount controlling plate 30 and the photosensitive drum 31 are shifted from 0V to −700 V, and the voltage of the developing roller 34 is also shifted from 0 v to −400 V to render the apparatus enter in the use status. Then, in substantially the same way as operation in FIG. 9, the apparatus enters in the printing phase at timing T12, and at timing T13, the voltage of the charge amount controlling plate 30 is changed to −1000 V from −700 V while the voltage of the developing roller 34 remains as −400 V. This supply of the developing agent collecting voltage is made by switching the voltage source from the high voltage power source to the high voltage power source 43 according to the controlling signal from the controller 41. This developing agent collecting voltage is continuously supplied until timing T14, and at timing T14, the voltage of the charge amount controlling plate 30 is returned from −1000 V to −700 V.

During the period (T13 to T14) that the developing agent collecting voltage is applied, the voltage applied to the charge amount controlling plate 30 is −1000 V, electrostatic force is exerted to high charged toners (negatively charged) in the direction from the charge amount controlling plate 30 toward the developing roller 34 even where the high charged toners having large absolute values of negative charges are made to cling to the charge amount controlling plate 30. Consequently, the high charged toners clinging to the charge amount controlling plate 30 can be removed effectively, and therefore, the charge amount controlling plate 30 works continuously as such a member in removing the toners otherwise causing fogs.

Then, at timing T15, the apparatus enters in the printing phase again, and at timing T16, the subsequent developing agent collecting voltage is supplied. Thereafter, this operation is repeated when plural sheets of images are formed.

In the developing apparatus according to this embodiment, the toners can be removed by the charge amount controlling plate 30 before the toners otherwise causing fogs come to cling to the non-latent-image portions on the photosensitive drum 30, and therefore, image defects in images formed by this electrophotographic method can be surely reduced. Toners may cling to the charge amount controlling plate 30 much more by removing toners causing defects, but such toners clinging to the charge amount controlling plate 30 can be effectively removed in application of the developing agent collecting voltage during the period corresponding to the image non-forming region. Therefore, the image forming apparatus of this embodiment can always form images with greatly reduced fogs.

It is to be noted that in FIG. 9 and FIG. 10, the toners removed from the charge amount controlling plate 30 are illustrated as of the reverse charged and the high charged toners. The developing agent collecting voltages for the reverse charged and the high charged toners may apply alternatively during the period corresponding to the image non-forming region. Although the charge amount controlling plate 30 is formed in a rectangular plate shape having a curve surface, the controlling plate 30 can be in a round bar shape, a rectangular bar shape, a grid shape, or other shapes. The controlling plate 30 can be not only a single charge amount controlling member but also a combination of plural charge amount controlling members. To enhance the fog removing effect at each end, the member can have a wider width at each end than that of a center portion, or the member can be designed to have a shorter distance at each end than at the center portion.

Although in the above embodiments, the toners as developing agents are described as a non-magnetic single-component, the toners can be dual components. Although photosensitive drums are exemplified as a latent image carrier, the carrier can have other forms such as a flat plate shape and a belt type. Although the charge amount controlling member is illustrated as disposed in facing to the surface of the developing roller on an upstream side, in the rotation direction of the developing roller, of the developing position at which the latent image carrier and the developing roller face to each other, the charge amount controlling member is not limited to a stationary type and can be a movable type in which the member is movable in a range not producing aerial discharge. The respective voltages of charge amount controlling member, the developing roller, and the photosensitive drum can be changed according to property of the toners serving as developing agents, usable voltages to be applied are not limited to those described in the above embodiments.

According to the developing apparatus and the image forming apparatus of the invention, all the toners otherwise possibly causing image defects such as high charged toners, low charged toner, and reverse charged toners are made to cling to the charge amount controlling member before clinging to the latent image carrier, so that clinging to the latent image carrier is surely reduced by that portion, and so that image defects formed by this electrophotographic method can be reduced.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but should be defined by claims as set forth below.

What is claimed is:

1. A developing apparatus for developing latent images comprising:

a latent image carrier on which latent images are formed;

a developing roller for developing latent images on the latent image carrier by forming a layer made of developing agents on the developing roller; and a charge amount controlling member for removing the developing agent charged outside a target range from said developing roller through a voltage that is supplied from a power supply provided different from that for the developing roller, and has the same voltage polarity, with respect to the voltage of the developing roller, as the voltage polarity of non-latent-image portions on the latent image carrier, the charge amount controlling member being disposed in facing to a surface of the developing roller on an upstream side, in a rotation direction of the developing roller, of a position at which the latent image carrier and the developing roller face to each other.

2. The developing apparatus according to claim 1, wherein the developing roller is not in contact with the latent image carrier and is biased with an alternative voltage to make the developing agents cling to the latent image carrier according to the alternative voltage.

3. The developing apparatus according to claim 2, wherein a time average value of electric field intensity at a position that the distance between the charge amount controlling member and the developing roller becomes the shortest is no less than a time average value of electric field intensity between the developing roller and the non-latent-image portions on the latent image carrier.

4. The developing apparatus according to claim 1, wherein the voltage polarity of the charge amount controlling member with respect to the developing roller is the same polarity as that of charges given to the developing agents.

5. The developing apparatus according to claim 1, wherein the charge amount controlling member is made of a roller member or a plate member.

6. The developing apparatus according to claim 1, wherein a developing agent collecting voltage for directing electrostatic force exerted to the developing agents clinging to the charge amount controlling member in a direction from the charge amount controlling member toward the developing roller is fed between the developing roller and the charge amount controlling member at a position that an image non-forming region forming no image exists on the latent image carrier.

7. The developing apparatus according to claim 6, wherein the developing agent collecting voltage is a voltage rendering the voltage polarity of the charge amount controlling member with respect to the developing roller the same polarity as the charges possessed by the developing agents clinging to the charge amount controlling member.

8. The developing apparatus according to claim 6 or claim 7, wherein the developing agent collecting voltage includes a direct current voltage component and an alternative current voltage component.

9. An image forming apparatus comprising:

a latent image carrier on which latent images are formed;

latent image forming means for forming the latent images on the latent image carrier;

a developing apparatus for developing the latent images formed on the latent image carrier; and transferring means for transferring the developed images on the latent image carrier to a transfer material, wherein the developing apparatus includes a developing roller for conveying developing agents to the latent image carrier for development, and a charge amount controlling member for removing the developing agent charged outside a target range from said developing roller through a voltage that is supplied from a power supply provided different from that for the developing roller, and has a voltage having the same voltage polarity, with respect to the voltage of the developing roller, as the voltage polarity of non-latent-image portions on the latent image carrier, the charge amount controlling member being disposed in facing to a surface of the developing roller on an upstream side, in a rotation direction of the developing roller, of a position at which the latent image carrier and the developing roller face to each other.

10. The image forming apparatus according to claim 9, wherein a developing agent collecting voltage for directing electrostatic force exerted to the developing agents clinging to the charge amount controlling member in a direction from the charge amount controlling member toward the developing roller is fed between the developing roller and the charge amount controlling member at a position that an image non-forming region forming no image exists on the latent image carrier.

* * * * *